US007381117B2

(12) United States Patent
Barous

(10) Patent No.: US 7,381,117 B2
(45) Date of Patent: Jun. 3, 2008

(54) COMPOUND HOOK AND LOOP DRUM SYSTEM FOR A FLOOR SANDER

(76) Inventor: Francis A Barous, 1118 Lakeview Ave., Dracut, MA (US) 01826

( * ) Notice: Subject to any disclaimer, the term of this patent is extended or adjusted under 35 U.S.C. 154(b) by 0 days.

(21) Appl. No.: 11/535,119

(22) Filed: Sep. 26, 2006

(65) Prior Publication Data

US 2007/0105489 A1 May 10, 2007

Related U.S. Application Data

(63) Continuation-in-part of application No. 11/183,547, filed on Jul. 18, 2005, now Pat. No. 7,128,640.

(60) Provisional application No. 60/588,913, filed on Jul. 16, 2004.

(51) Int. Cl.
*B24B 23/00* (2006.01)

(52) U.S. Cl. ..... 451/352; 451/359

(58) Field of Classification Search ..... 451/352, 451/359, 496, 490, 507, 350
See application file for complete search history.

(56) References Cited

U.S. PATENT DOCUMENTS 1,395,468 A 11/1921 Beal
1,640,933 A 8/1927 Gries
2,093,779 A * 9/1937 Mapps ..... 451/352
2,375,102 A 5/1945 Harris
5,380,239 A * 1/1995 Casillas et al. ..... 451/496
6,645,054 B2 11/2003 Raffo, Sr.
6,685,547 B2 * 2/2004 Boman ..... 451/495

FOREIGN PATENT DOCUMENTS

AU 16669/56 3/1956
GB 400754 11/1932

* cited by examiner

*Primary Examiner*—Robert Rose
(74) *Attorney, Agent, or Firm*—Vern Maine & Associates

(57) ABSTRACT

A powered floor sanding system with a motorized drum-type floor sander with a sanding drum configured as a drum core with a compliant sole covered with a first component layer of a hook and loop fastener system, to which is fastened a removable drum surface of back to back layers of hook and loop fastener materials. The removable drum surface is replaceable if damaged. A sanding blank alignment guide at or below the height of the removable drum surface provides for alignment and hand wrapping of a sanding blank laminated back to back with one component of a hook and loop fastener system around the removable drum surface. The alignment guide may also be used to fasten the removable drum surface to the drum core.

18 Claims, 9 Drawing Sheets

28
26
1.5
28
26
20
27

COMPOUND HOOK AND LOOP DRUM SYSTEM FOR A FLOOR SANDER

This application is a continuation in part of U.S. application Ser. No. 11/183,547 filed Jul. 18, 2005, now U.S. Pat. No. 7,128,640 which is a non-provisional application claiming the benefit of U.S. Provisional Application No. 60/588,913 filed Jul. 16, 2004.

BACKGROUND OF THE INVENTION

Powered disk and drum sanders are commonly known and used for sanding floors and other surface areas. Floor sanders designed specifically for floor surface applications are of the motorized drum sander type. Traditionally, the leading and trailing edges of a sheet of sand paper are secured within a slot on the drum by a paper edge gripping mechanism in order to hold the sand paper on the drum. There are other methods of doing it; such having three screws securing a bar that captures the butting edges of the sheet. The screws are known to come loose and scrap the floor. All of these methods rely on the butt joint as the point of security, the point where the sheet is attached to the drum. The remaining surface area of the sheet is wrapped around the drum but is not secured to the drum body or surface.

There are other methods of mounting disposable sanding material to sanders. One method employs a loop or belt of sand paper that must be slid over one end of the drum, where the drum is supported on the sander at its other end by a heavy bearing. The belts may be used in combination with drums of retractable diameters which are then expanded to hold the belt in place. The drum designs are complex, and often don't perform well due to the expansion mechanisms, causing excessive "chatter" in use and leaving undesirable marks on the sanded floor surface.

Other types of sanders such as hand held or bench mounted rotating disk sanders (as opposed to drum sanders) have been known to try to use hook and loop fastener materials such as Velcro® brand material to secure the sand paper to the flexible sanding pad. However, the load and load distribution are markedly different for a disk sander than for a drum. There is not the continuous weight of a floor sander bearing on the contact interface causing increased pressure and temperature at the sandpaper to pad attachment interface, there is no centrifugal force normal to the attachment interface attempting to dislodge the sandpaper from the pad, and there is no paper joint on the sanding disk exposed to the leading edge lip peeling action of the passage of sandpaper over the surface or floor being sanded. The contact area or pressure print of a rotating sanding disk to the floor is typically constrained to less than one side of the disk area, and so excludes the region of the point of attachment, at the center of the disk.

For all drum type floor sanders, the weight of the machine combined with the rotating drum works to remove material from the floor surface. In finishing or re-finishing operations, some skill is required to achieve a satisfactory result. As is well known, the sanding sheets are consumed by use and must be replaced frequently. There is some user resistance to the effort and attention to detail that is required in order to install new sanding blanks with the necessary precision on the drum; so better and easier mounting methods are sought.

It is unknown to this Applicant for portable drum type floor sanders used with sand paper sheets to achieve commercial success using a hook and loop fastener system such as a Velcro® brand material to secure a sand paper blank to a fixed diameter drum surface where a joint in the sheet must be exposed to some extent on the drum surface. The reasons why can be readily deduced by one skilled in the art: rotational speed, machine weight, inherent resistant in the abrading motion, exposed leading edge of the sandpaper blank at a joint the drum, effects of the resulting high heat, peeling and shear pressure on the fastening materials, and cost. It has been tried without success by others.

It can be further stated as a generalization that some 30% of floor sander rentals are for use on floor surfaces than can be characterized as rough, such as by having excessive holes, missing or irregular boards, elevated nail heads, and/or other surface irregularities that increase the likelihood of tearing or otherwise damaging the sanding blanks or the drum surface of a floor sander. For this reason, it would be useful to provide a floor sander configured for more easily removing and replacing sanding blanks with correct alignment on the drum, and for easily repairing the drum surface of the sanding drum when necessary.

SUMMARY OF THE INVENTION

What is disclosed is a unique drum and sanding sheet configuration for attaching and using sand paper sheets or blanks to a fixed diameter drum by use of a compound hook and loop fastening system, and for repairing the drum surface should it become damaged. One embodiment of the invention, in its simplest form, is a drum with a replaceable drum surface layer of hook material that is attached to the drum by a hook and loop fastener system. For example, the drum may be configured with a loop material, and the replaceable drum surface layer may have a back side surface of hook material, providing a substantially continuous grip or attachment between the drum and the drum surface layer.

There may be a recessed retention bar hold down mechanism to aid in holding down the abutting ends of the replaceable drum surface layer. There is a recessed paper guide by which a paper sanding blank may be aligned as it is applied by a hook and loop fastening system to the surface layer of hook material. For example, the paper guide may consist of a channel or U-shaped extrusion that is secured to a recess extending from one end to the other end of the drum so as to provide a slot into which the end of a sanding blank can be set, thereby aligning it for rotational fitment to and around the drum surface layer.

The hook and loop fastening system for attaching the sanding blanks may, for example, consist of the drum surface layer being configured with hook material on its exposed surface, and the sanding blanks being configured with loop material on their back side, or vice versa.

The paper guide must be recessed to at or slightly below the height or radius of the drum surface layer so as to not interfere with rotational clearance of the drum and sanding paper in operation. The paper guide may be integrated with the retention bar hold down mechanism.

Using this or an equivalent structure, the paper sanding blanks are easily removed when the sand paper is damaged or worn so that it is no longer effectively sanding, and new sanding blanks can be easily aligned and attached by hand, all without use of tools. Furthermore, the replaceable drum surface layer of hook material is likewise easily replaceable with simple tools, typically a screw driver, if it is damaged or when it is otherwise worn out, by removing the retention bar hold down mechanism and peeling off the old drum surface layer, and aligning and installing a new drum surface layer.

In one embodiment, a precision fit of the retention bar and paper guide to the drum, aligned and secured for example by screws, pins, or other fasteners, insures that correct sanding paper alignment by use of the paper guide will be retained after a change of the drum surface layer.

In another embodiment, the drum has a somewhat compliant layer of dense material firmly attached by adhesive to a rigid drum core, and which is further uniquely modified by having its cylindrical surface being completed covered by a sheet of the hook component of a hook and loop fastener system, the backside of which is firmed attached to the compliant layer by a high temperature adhesive. The corresponding sanding sheets are backed or laminated with a loop component sheet or layer of fabric, using a high temperature adhesive, so that a sheet may be wrapped and attached by surface contact via the hook and loop interface over the full surface of the drum, with its sheet ends abutting in a joint line extending across the width of the drum, with the sanding surface exposed for sanding of a floor surface by weight of the sander and motor-driven rotation of the drum.

The invention is deceptively simple on its face, but not at all easily arrived at in practice. It was through extensive inventive efforts and experimentation that a practical solution to the problems posed by the prior art was developed and reduced to practice as elsewhere described herein and expressed in the appended claims.

Other objects and advantages of the invention will be apparent to those skilled in the art from the description and figures provided.

DETAILED DESCRIPTION OF THE PREFERRED EMBODIMENT

Figure 1:
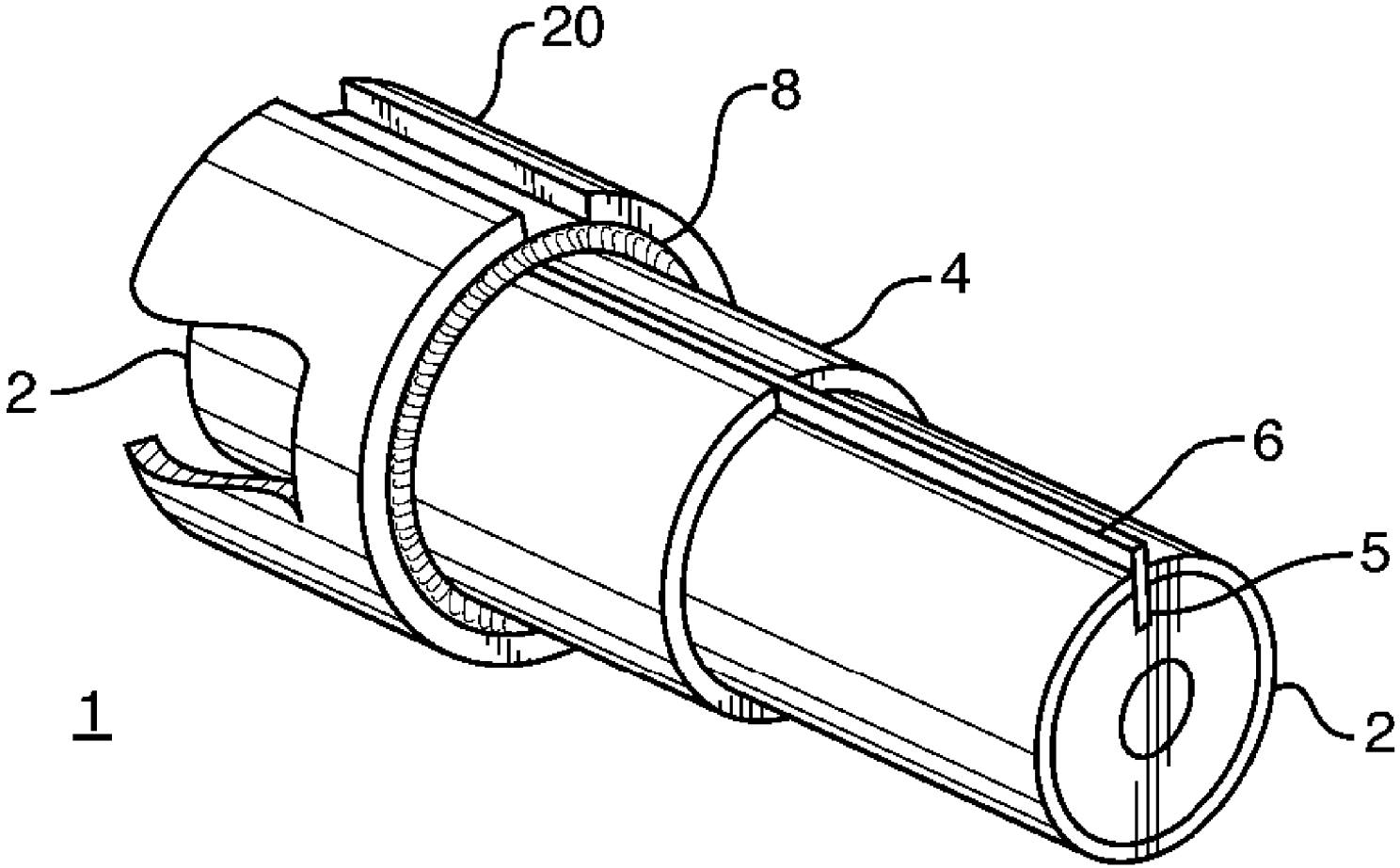
FIG. 1 is a perspective cut-away view of one embodiment of the invention, showing the metal drum core, alignment base plate, rubber sole, hook component of a hook and loop fastener system, for installation into a drum type, floor sander, and to which is attached a sandpaper blank by use of its loop component backing of the hook and loop fastener system, for floor sanding operations.
Figure 2:
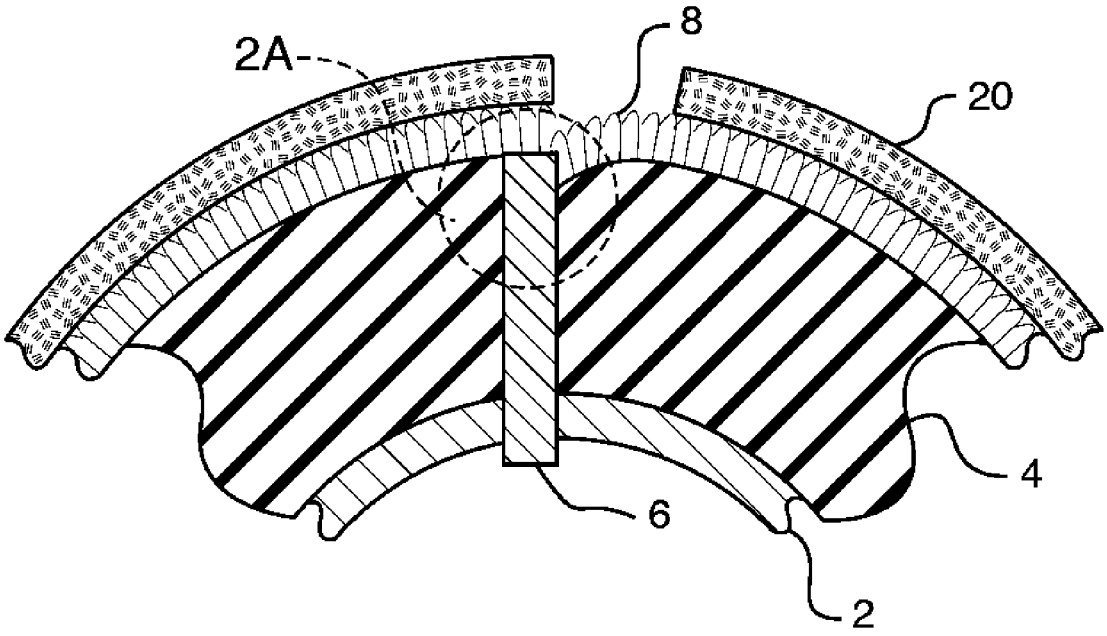
FIG. 2 is a partial cross section view of the FIG. 1 embodiment drum.
Figure 2A:
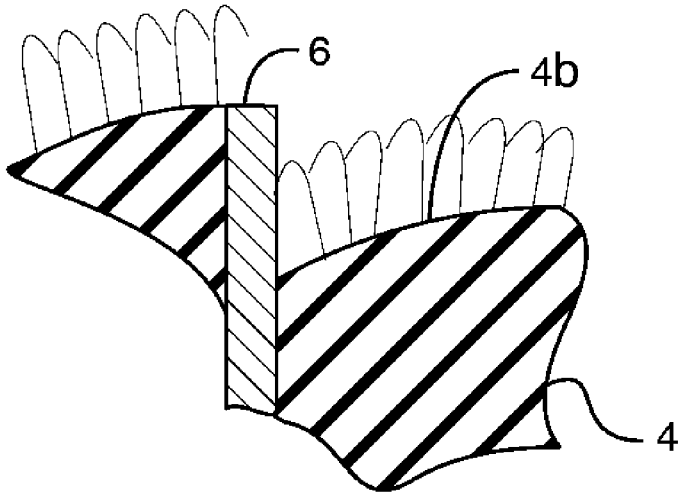
FIG. 2A is a close up partial view of FIG. 2, illustrating the ramp in the compliant substrate on the trailing side of the alignment plate.
Figure 3:
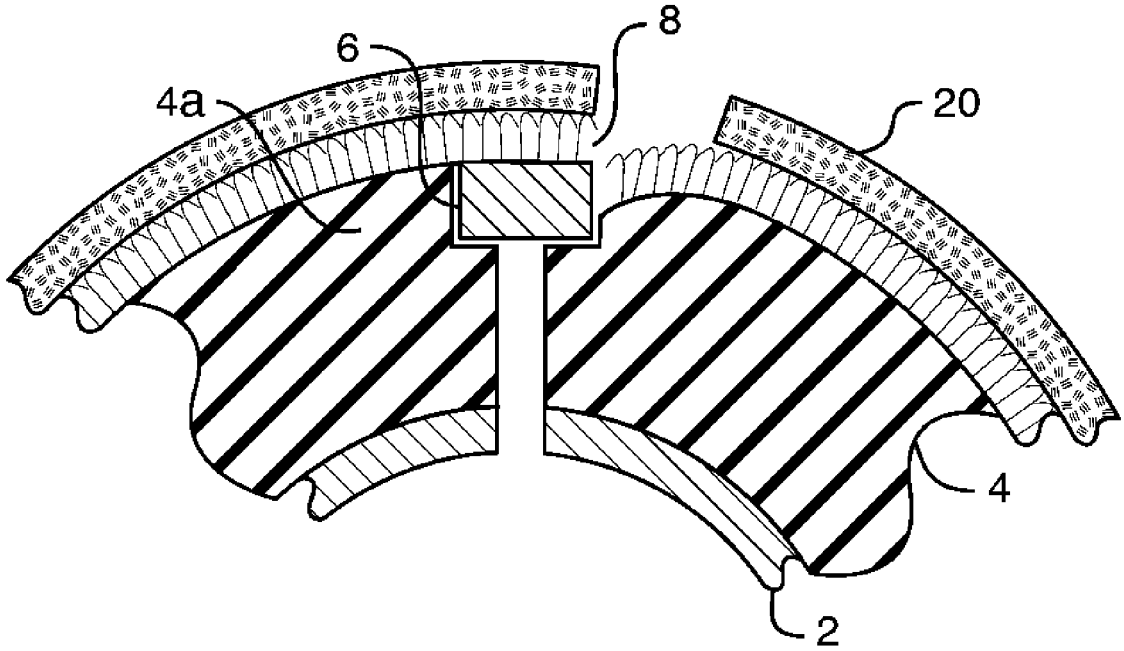
FIG. 3 is a partial cross section view of another embodiment drum, with an alternatively configured alignment bar or "base plate".
Figure 4:
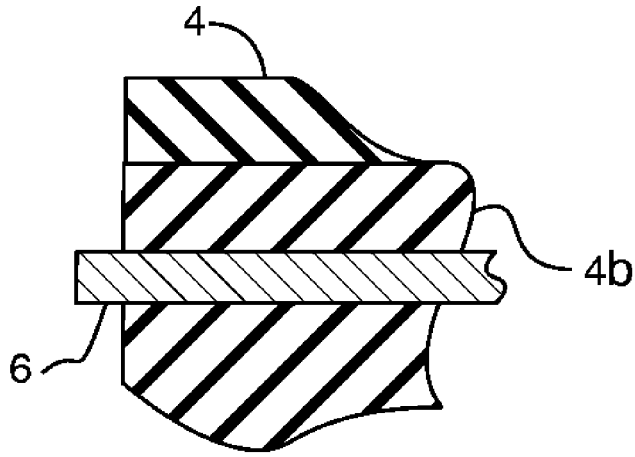
FIG. 4 is a topside partial view of the alignment bar indicating its slight extension beyond the drum end for visual alignment purposes.

The invention is susceptible of various embodiments. What follows are descriptions of preferred embodiments and should not be construed as limiting of the scope of the invention.

The Applicant, a manufacturer and supplier of industrial quality, drum-type, floor sanders for many years, recognized the long standing need to simplify the attachment of sanding sheets to the drum, and of simplifying the repair of the drums when damaged, to promote ease of use and greater productivity, particularly in the rental markets.

Referring to FIGS. 1-4, after considerable experimentation, a first workable embodiment was developed that has a soft rubber sole or compliant layer uniformly wrapped around a metal drum core and adhered to the drum core with a uniform coating of adhesive such as or equivalent to 3M brand Scotch-Grip brand 1300-L Rubber and Gasket Adhesive. There may be a metal bar termination strip set at a slight angle across the face of the sole to delineate the joint and abutting edge alignment of the sand paper sheets or blanks. The termination strip may be inserted into a slot in the rigid drum core and extend radially through the compliant layer, or it may lie exposed in a slot or depression in the compliant layer, isolated by the compliant layer from the drum core. There is a recess in the rubber sole or compliant layer on the trailing edge side of the alignment bar, which corresponds to the location of the leading edge of the sanding sheet when applied, and provides a slight depression for the leading edge of the sanding sheet as is further described below.

To the rubber sole or compliant layer there is adhered a sheet of high temperature tolerant, high strength hook material such as or equivalent to Velcro brand, Nylon, non-adhesive backed, style HTH 22 Hook, hook component material, adhered with a high performance adhesive such as or equivalent to 3M brand Scotch-Grip brand High Performance Contact Adhesive 1357. The sheet of thermoplastic hook material is positioned such that the trailing edge of the sheet is aligned with the leading edge side of the alignment bar, the hook material sheet wrapped around the rubber sole, and the leading edge terminating within the edge recess adjacent the alignment bar. The adhesive bond between the rubber sole and the sheet of fastener material is adequate to hold the hook component material in place, but is also manually peelable, facilitated by the use of a solvent such as acetone or other solvent suitable for the adhesive, for occasional replacement of the hook component material when wear or damage requires it. The adhesive provides a uniform grip over the full surface area of the hook component, holding it to the compliant layer of the drum, and tolerates the high heat and pressure of sanding, but remains peelable with the use of acetone for replacement when required.

One embodiment of a sand paper sheet is a paper or fabric or composite paper/fabric-backed sanding sheet. Paper backed sanding sheets are normally provided for the floor sander rental market in grit numbers from #100 to #36; as are nylon reinforced paper backed sheets in grit numbers #20 to #12. Commercial grade sheets may have a resin over resin construction for greater durability under higher temperature and pressure and can be paper/fabric composites used in all grit sizes from smaller than #100 to as coarse or low as #16-4 or lower.

To the back side of the sanding sheet is laminated or adhered a 100% Nylon, low profile loop material fabric, of a weight of 3.0 oz. per square yard or 101.4 grams/meter2. It is laminated using a hot melt polyurethane adhesive capable of withstanding temperatures in excess of 300 F. The hook component and the loop fabric material of the fastener system each have a yet a higher temperature rating.

The drum and sheet combination is sized so that there is normally an intentional small gap between the trailing edge and the leading edge of the sanding sheet when wrapped on a new drum; which permits the rubber sole and drum assembly to be resurfaced to a slightly smaller diameter once or twice over the life of the drum and still accommodate the same size sanding paper blanks.

The placement of the sanding blank on the drum is important to assure a smooth wrap with fully functionally hook and loop engagement over the entire surface; especially at the leading and trailing edge or butt joint.

The size and speed of the drum rotation is preferably limited, such as to not more than 2800 rpm (rotations per minute), although speeds of not more than 2400 rpm are preferred, for 5½ and 7 inch diameter drums has been demonstrated to be effective without failure due to the centrifugal peeling force on the leading and trailing edge of the sandpaper sheet. Drum lengths of 8 to 12 inches have been demonstrated, although shorter and longer drum lengths are considered to be within the scope of the invention, up to the limit of drum core rigidity. The soft rubber sole or compliant layer in combination with the leading edge recess provides a smooth, chatter-free, trailing edge to leading edge transition for the sanding sheet during each rotation of the drum so that normal sanding operations are not affected by the joint line, and there is no visible affect in the results of the workpiece or floor being sanded.

Referring still to FIGS. 1-4, and 6 the construction of the Applicant's standard size 5½ inch diameter by 8 inch long drum 1 is illustrated. Normal drum rotation is counterclockwise with respect to the drum cross section views of FIGS. 2 and 3. A somewhat compressible circumferential sole or substrate 4, preferably a layer of rubber or polyurethane of about one half inch thickness and of about 22 durometer, or generally within a range of about 20-25 durometer inclusive, is disposed around drum core 2. The drum core is about 4½ inches or slightly larger in diameter. The compressible substrate is adhered to the drum over its entire cylindrical surface area using a layer of suitable adhesive 3. An alignment base plate 6, preferably an aluminum strip at least the length of the drum, and about ⅛ inch thick, is configured transversely across and within a slot 5 in the drum core and substrate 4 layer and running lengthwise of the drum.

The first working iterations of the invention used the existing slot 5 in the existing drum core design (a legacy of the former slot-grip mechanism) for installation of the base plate 6 so that it protruded radially from the drum core. Later embodiments oriented the base plate flatwise in a slot or recess 4A on the rubber substrate 4, providing more cushioning for the base plate. Accordingly, the base plate may be oriented radially or tangentially with reference to the drum, or simply be of square cross section and oriented tangentially. It may have a taper of between about 5 to 10 degrees, preferably 5½ degrees off square which will coincide with the slightly angular end cut on the abutting sheet ends as they wrap around the drum. At the right side of the baseplate 6 as viewed in FIGS. 2 and 3, the back side of the base plate, a leading edge ramp 4B is milled into or otherwise recessed in the substrate 4 layer, preferably about ¼ inch wide and sloped at about 30% from a surface tangent down to the backside of the base plate 6.

A conforming sheet 8 of high strength hook component material of a hook and loop fastener system, the "hook" component, is aligned with the baseplate 6 and glued, using for uniform adhesive layer 7 the contact adhesive cited previously, to the rubber substrate 4 so as to be removable by careful peeling without significant damage to the rubber substrate, yet be securely enough attached to the rubber layer so as to provide a full surface gripping system for holding a loop fabric backed sandpaper sheet 20 to the drum for extended periods of floor sanding use. The baseplate 6 serves as the edge guide for initial alignment of the trailing edge of the sandpaper blank. The drum is run at preferably not more than about 2400 rpm, but it may be up to 2800 rpm, which limits the centrifugal force on the sandpaper sheet and still provides good rotary inertia and sanding action. Professional models may have larger drum diameters, up to 7 inches and more, and be operated at even lower speeds, for example as low as 1600 rpm or as high as 2800 rpm. Actual floor weight per surface area of the sanders thus equipped and operated may be as much as 145 psi (pounds per square inch), but is preferably closer to 50 psi. Floor weight per surface area is measured as the width times drum length of a contact line of a floor sander and revolving drum bearing on a steel plate coated with a layer of markover paint.

Other embodiments, examples and variations of the floor sander and drum component of the invention will be evident to those skilled in the art. For example, there is a drum for a drum sander consisting of a drum core attachable to a drum sander for rotatingly contacting a work surface such as a floor, to which is attached a compliant sole such as a rubber layer or substrate. There is an alignment bar embedded in the compliant sole not higher than flush with the surface of the compliant sole. There is a leading edge sloping recess in the compliant sole terminating at the alignment bar. There is a sheet of hook component fastener material aligned by one edge with the alignment bar and adhered around the drum to the compliant sole so as to conform the opposing edge of the base fastener to and within the sloping recess. There is a sanding material sheet, to the backside of which is laminated a nylon loop fabric with a high temperature adhesive, the sheet sized to abut the backside of the alignment bar and wrap fully around the drum so as to firmly and fully engage the hook and loop components over the full surface area of the drum.

Figure 5:
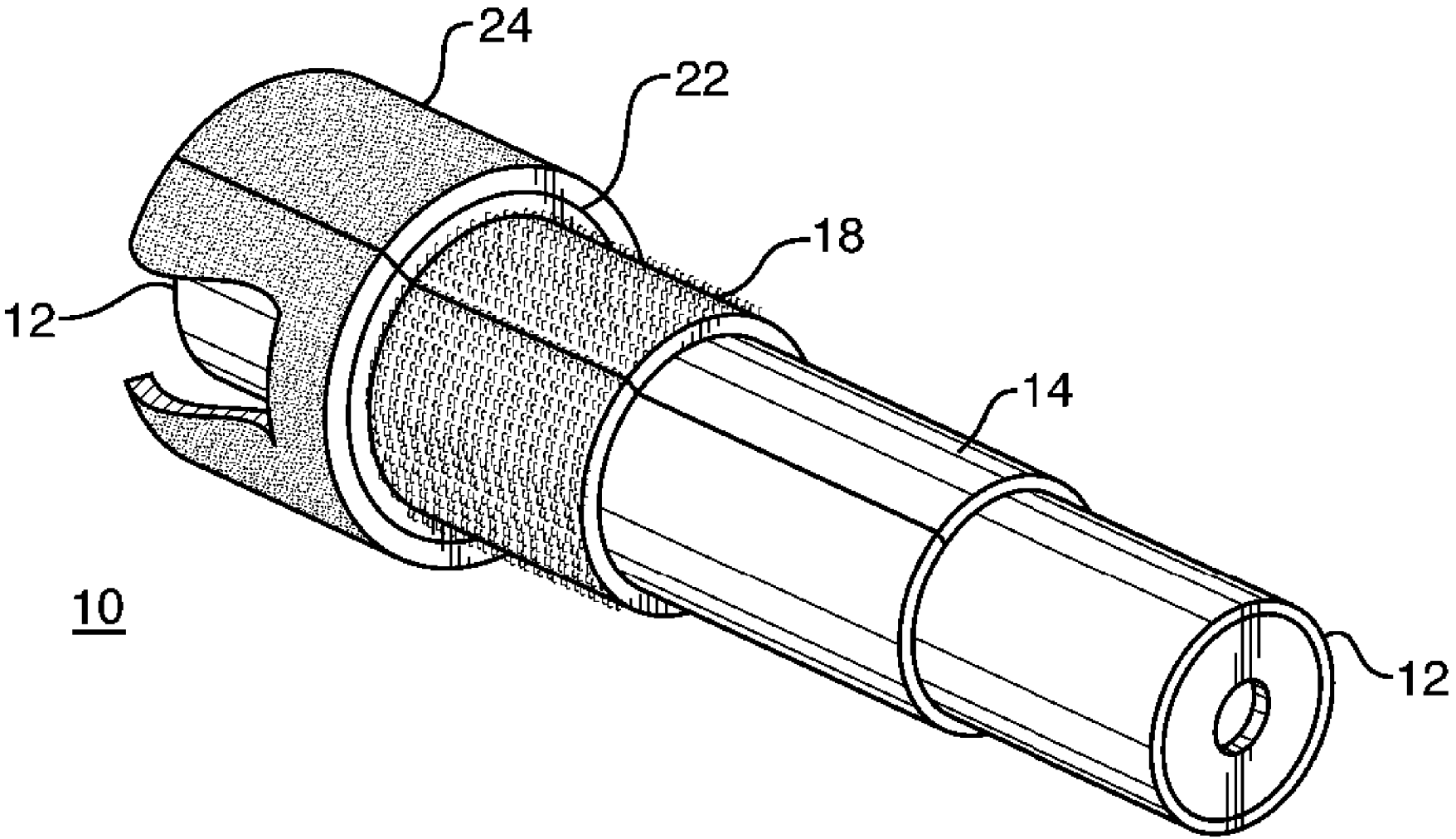
FIG. 5 is a partial perspective cut-away view of yet another embodiment of the invention, where the base plate and indentations of the FIG. 1 embodiment are not present.
Figure 6:
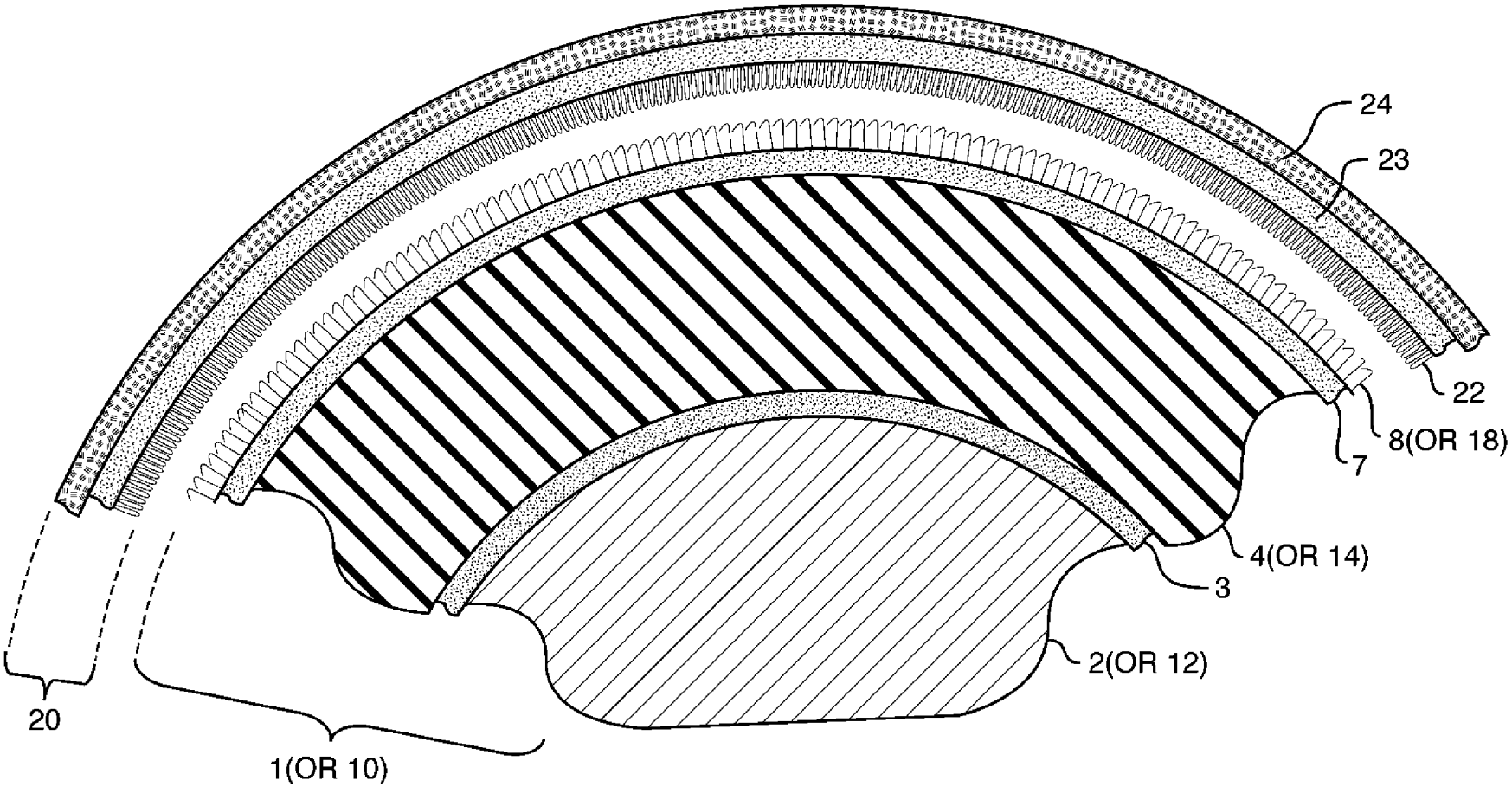
FIG. 6 is a partial cross section view of a drum and sanding sheet of the invention, illustrating in order the drum core, first adhesive layer, compliant substrate layer, second adhesive layer, and hook component layer of the drum; and the loop component layer, first adhesive layer, and sand paper layer of the sanding sheet.

Not satisfied with the above embodiments, Applicant conducted additional testing and experimentation attempting to further simplify the drum and the changing of sanding materials. Referring now to FIGS. 5 and 6, a further embodiment resulting from this continuing work is illustrated in another drum example. This drum is the same diameter as the drum of the prior example, however a larger 7 inch diameter has been tested as well, and 7 inch diameter by 12 inch long drums such as are made by the Applicant are within the scope of the invention. The drum 10 of this embodiment is a direct replacement for the Applicant's conventional drums that use the slotted gripping mechanism, for use in its drum type, floor sanders. Normal drum rotation is counterclockwise with respect to the perspective partial cutaway view of FIG. 5, although it will be appreciated that drum rotation in this embodiment can be in either direction with respect to the sanding sheet 20 attachment aspects of the invention as illustrated in FIG. 6.

The FIG. 5 drum embodiment is analogous to the embodiments of FIGS. 1-4 in several respects, but is clearly distinguishable in important respects. A somewhat compressible circumferential substrate 14, preferably a layer of high density foam rubber or polyurethane of about 20-25, preferably 22 durometer and about one half inch thick, is disposed around a drum core 12, using the adhesive layer 3 of FIG. 6 described previously for this purpose. There is no requirement for a slot or other variation to the otherwise uniformly smooth cylindrical surface of drum core 12. The alignment base plate of the earlier embodiment has been removed, allowing substrate 14 to completely wrap around the drum and terminate end to end with at a well-aligned, closely fitting butt joint that needs no particular angular offset, and can in fact be a square butt joint for convenience.

Applicant's further improvements and testing have demonstrated that there is no need for a ramp or indentation in this embodiment for the leading edge or trailing edge of the sanding blank, so substrate 14 is of uniform diameter including the area of its butt joint. A conforming sheet 18 of the same hook component of a high strength hook and loop fastener system as described in the above embodiment is adhered to the rubber substrate 14, using the same adhesive layer 7 of FIG. 6 described above. There being no ramp or indentation in substrate 14, sheet 18 is similarly applied with a smooth butt joint that may be square or may be set at a slight angle off square, and may be aligned with as shown in FIG. 5 but is preferably rotationally offset from the butt joint in substrate 14.

Referring now to FIG. 6, there is illustrated a partial cross section view of a drum and sanding sheet of the invention, illustrating in order the drum core, adhesive layer, compliant substrate layer, adhesive layer, and hook component layer of the drum; and the loop component layer, adhesive layer, and sand paper layer of the sanding sheet. For clarity, sanding sheet 20 is illustrated proximate to but not contacting drum 1; the loop material 22 of sheet 20 proximate the hook component 8 of drum 1 but not engaged or interlocked. Sanding sheets 20 are an important component of the invention, and comprises in one embodiment a paper-backed sanding sheet material 24 to which is laminated or adhered the low profile Nylon loop component fabric 22 of the hook and loop fastener system described previously, with the adhesive layer 23 described in the previous embodiment for this purpose, where the system components are specified to be relatively heat resistant and the hook and loop components sufficiently robust individually and in combination to withstand the heat and pressure of the floor sanding application.

Referring back to FIGS. 1-4 and FIG. 6, a sanding sheet 20 with its loop fabric backing is sized to wrap fully around drum 1 and be fully engaged with hook component 8, with its leading edge extending slightly into the recess 4B behind plate 6. There may be a gap between the trailing edge and the leading edge. There is no overlap.

Referring to FIGS. 5 and 6, a sanding sheet 20 with its loop fabric backing is sized to wrap fully around drum 10 and be fully engaged with hook component 8, and likewise terminate in an end to end well-fitted butt joint that may have an offset but may be a square joint, and may be aligned with the joint of substrate 14 and/or hook component 8 but is preferable offset or rotationally separated by at least a few degrees. The trailing edge to leading edge joint in sheet 20 may have a slight gap. There is no overlap.

It will be readily understood that the drum, under the weight and power of the floor sander, is driven in rotation and puts the sanding sheet and underlying layers of the drum in the area of contact of the drum to the floor under compression, while pulling the sanding sheet around by all of its hook and loop fastening interface against the resistance of the floor, so as to abrade the floor, removing material from the surface. A myriad of forces are at play at the nip and in the contact area between the drum and the floor, where the compression and drag are applied to the sanding sheet first, including its joint, and translated through the hook and loop interface to the compliant layer of the drum and hence to the drum core.

The thermoplastic hooks of these embodiments hook component 8 are molded in uniform rows and columns on a backing layer yielding a density of 900 hooks per square inch, rows defined as running with the roll or web of material as produced and columns as running across the roll as produced. The hook direction is oriented with the rows, 50% facing in one direction and 50% in the other direction, with hooks of either direction uniformly distributed within the array. The hook component sheets, sized for their respective drums, are cut from the supplied roll of hook component material so as to maintain or repeat the same orientation on the drum as was present in the roll; that is, the rows of hooks are wrapped and running around the drum, and the columns run across the face or length of the drum.

Maintaining the same orientation of the hook material from roll to drum has two benefits. First; the bending bias of the hook component backing layer resulting from the manufacturing and rolled packaging process is repeated on the drum, minimizing the introduction of any new bending stress in the hook component backing layer. Second, the hook component material is oriented with the plane of the hooks aligned with the direction of rotation, 50% facing in one direction and 50% facing in the other direction. Hence the hook material can be applied to the drum without regard to the intended direction of rotation. Consequently, drum 10, with respect to its hook component material, can be rotated in either direction with the same effective hook holding power.

Which ever way rotated, the resistance to rotation caused by the drag of the sanding paper tends to draw or pull the loop fabric component into further engagement with at least the forward facing hooks of the hook component material.

The thermoplastic hook material sheet 18 of this embodiment is as described in the embodiments above, but the scope of the invention includes variations from the specified hook engagement depth of 0.008 and hook height of 0.028 in., and 900 hook psi density that will provide an equivalent fastening power between the sanding sheet and the drum. Applicant's testing has demonstrated a peel line strength failure limit of 7-9 pounds per lineal inch of peel line for the described hook and loop attachment system of the invention, as measured by peeling a one square inch sample sanding sheet off a 5½ inch drum, staring along one of the one inch long edges. Preferred embodiments have a peel line attachment strength of at least 5 pound per lineal inch. The shear strength limit of the attachment system, analogous to the effect of floor resistance to drum rotation tending to pull the sandpaper along or over the drum surface, measured using a one square inch sample, was 24-26 psi. Preferred embodiments have a shear strength of at least 20 pounds per square inch. Centrifugal strength, pulling resistance normal to the attachment interface, using one square inch samples of sanding sheets attached to a drum in accordance with the invention, and superglued to a one square inch surface area pulling block, measured 22-23 psi at the point of failure, nearly the same as shear strength. Preferred embodiments have a centrifugal attachment strength of not less than 20 pounds per square inch.

Hook component sheet 8 or 18 is applied to respective substrate 4 or 14 with a uniform coating layer 7 of the previously specified adhesive. The adhesive is applied to the surface of the substrate, and the hook component sheet is then tightly wrapped on it and retained until the adhesive sets properly. The use of this type adhesive permits the hook material sheet to be manually removed for replacement by careful peeling from the corner of the joint edge, without damage to the compliant substrate. Yet the hook component is securely enough attached by the cured adhesive layer 7 to the substrate so as to hold a sandpaper sheet 20 to the drum for extended periods of floor sanding use.

As in earlier embodiments, the drum 10 style of drum is operated in the range of 1600 to 2800 rpm, which keeps the centrifugal force on the sandpaper sheets at acceptable levels and still provides good rotary inertia and sanding action. Professional models may have larger drum diameters, and be operated at lower speeds, preferably about 1600 rpm. Again, actual floor weight per surface area of the sanders thus equipped and operated may be as much as 145 psi (pounds per square inch), but is preferably closer to 50 psi.

Other embodiments are within the scope of the invention. For example, there is a powered floor sanding system consisting of a motorized floor sanding machine adapted to accept and rotate a sanding drum that consists of a drum core with a cylindrical surface to which is adhered by a first adhesive layer a compliant sole, to which is adhered by a second adhesive layer a hook component of a hook and loop fastener system so as to substantially encompass the drum with an outwardly exposed layer of the hook component cushioned by the compliant sole. There is a sanding sheet comprising a sand paper blank with a loop fabric component of the hook and loop fastener system laminated to the backside thereof using a loop fabric adhesive of high temperature tolerance. The sanding sheet is wrappable (may be manually wrapped around the drum) as previously described around the sanding drum such that the loop fabric component is fully engaged with the hook component, and the leading and trailing edges of the sanding sheet form a joint without overlap.

The hook component may consist of Velcro brand, Nylon, non-adhesive backed, style HTH 22 Hook material or other equivalent hook material. The floor sander may be operable within a range of 1600-2800 rpm. The drum may be configured with an alignment bar for mounting the sanding sheet. The drum may have a recess for the leading edge of the sanding sheet. The high temperature tolerance may be at least about a 300F tolerance. The first adhesive layer may be 3M brand Scotch-Grip brand 1300-L Rubber and Gasket Adhesive or other equivalent adhesive. The second adhesive layer may be 3M brand Scotch-Grip brand High Performance Contact Adhesive 1357 or other equivalent adhesive. The loop fabric component may be 100% Nylon, low profile loop material fabric. The loop material fabric may have a weight of about 3.0 oz. per square yard. The loop fabric adhesive may consist of a hot melt polyurethane adhesive capable of withstanding temperatures up to at least 300 F.

The powered floor sanding system may have a weight of floor sander on drum and sanding sheet of within the range of 50 to 145 psi. The sanding sheet when fully engaged with the drum may be inseparable from the drum by a shear force of less than 20 psi.

Referring to FIGS. 7-10, another embodiment of the invention consists of four major components; a drum 10, a removable drum surface 20, a paper guide 30, and a sanding blank 40. Referring first to the drum, there is a soft rubber sole or compliant layer 13 of substantially the same width as the drum length, uniformly wrapped around metal drum core 11 and adhered to the drum core with a uniform coating 12 of adhesive such as or equivalent to 3M brand Scotch-Grip brand 1300-L Rubber and Gasket Adhesive. There is a retention slot 17 provided between the ends of compliant layer 13, as will be further described below.

To the rubber sole or compliant layer 13 there is adhered a sheet of high temperature tolerant, high strength hook material 15 such as or equivalent to Velcro brand, Nylon, non-adhesive backed, style HTH 22 Hook, hook component material, with its hook surface exposed outward, by a layer 14 of high performance adhesive such as or equivalent to 3M brand Scotch-Grip brand High Performance Contact Adhesive 1357. Other higher or lower specification hook or loop fastener material may be used. The sheet of thermoplastic hook material 15 is sized and aligned on all sides with compliant layer 13.

Figure 7:
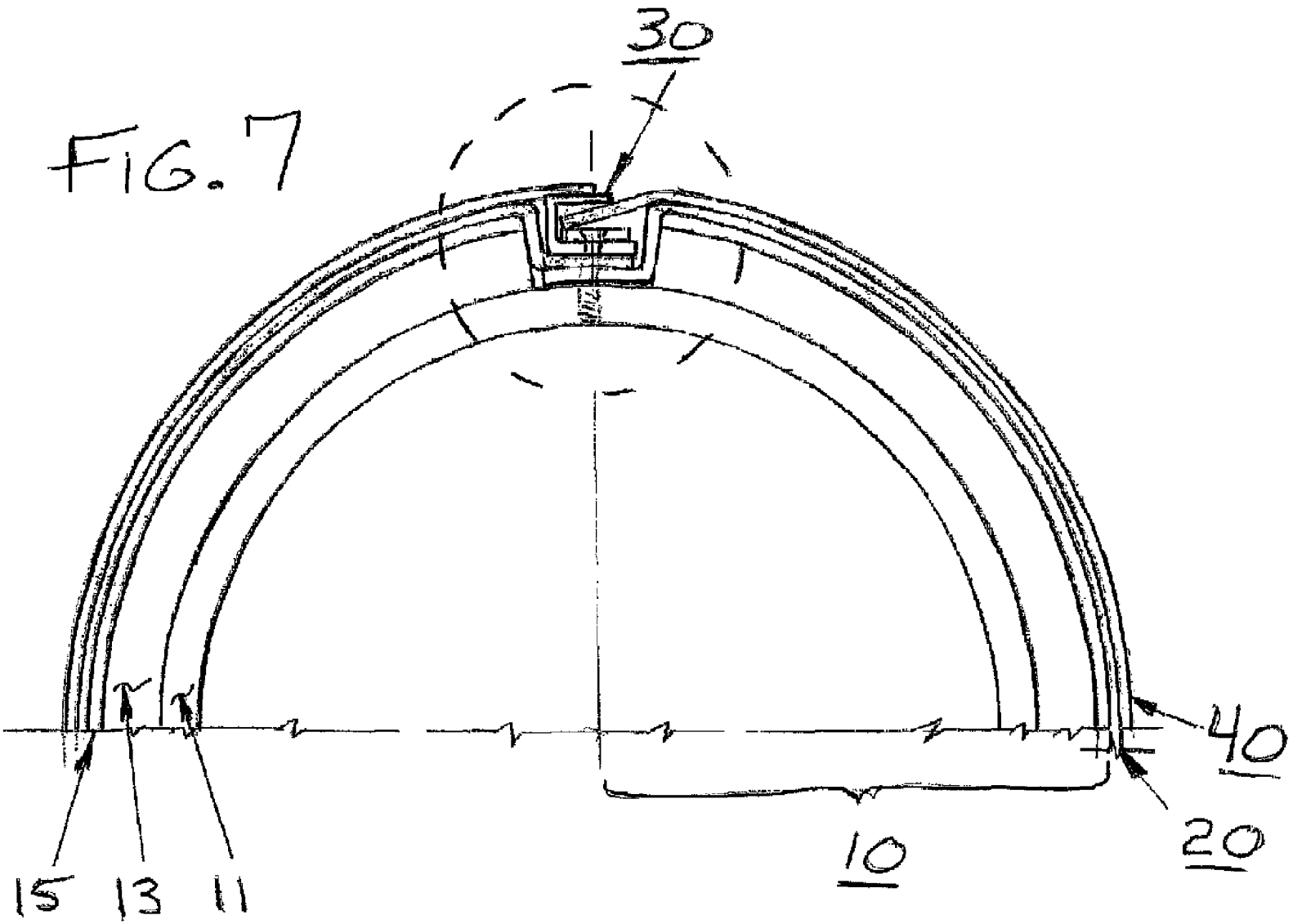
FIG. 7 is partial cross section view of another embodiment of the invention, illustrating a drum with a loop material surface, a replaceable drum surface layer with hook configured underside and hook configured topside, an integrated and recessed paper guide and hold down mechanism retaining the overlapping ends of the drum surface layer, and a loop backed sanding blank with one edge inserted in the paper guide.

The removable drum surface 20 consists of two layers 26 and 28 of the hook material component of a hook and loop fastener system; the two layers adhered back to back by adhesive layer 27 such that there is a hooked surface underside layer 26 for contacting the drum hook material 15 for attachment of the removeable drum surface 20 to drum 10, and a hooked surface topside layer 28 to receive a loop backed sanding blank 40 on the drum surface layer 20. In one embodiment, illustrated in FIGS. 9A-9C, layer 28 extends about 1.5 inches longer on each end of removable drum surface 20, so that it can extend into retention slot 17 as shown in FIGS. 7 and 8, where it is mechanically secured to the drum.

Figure 8:
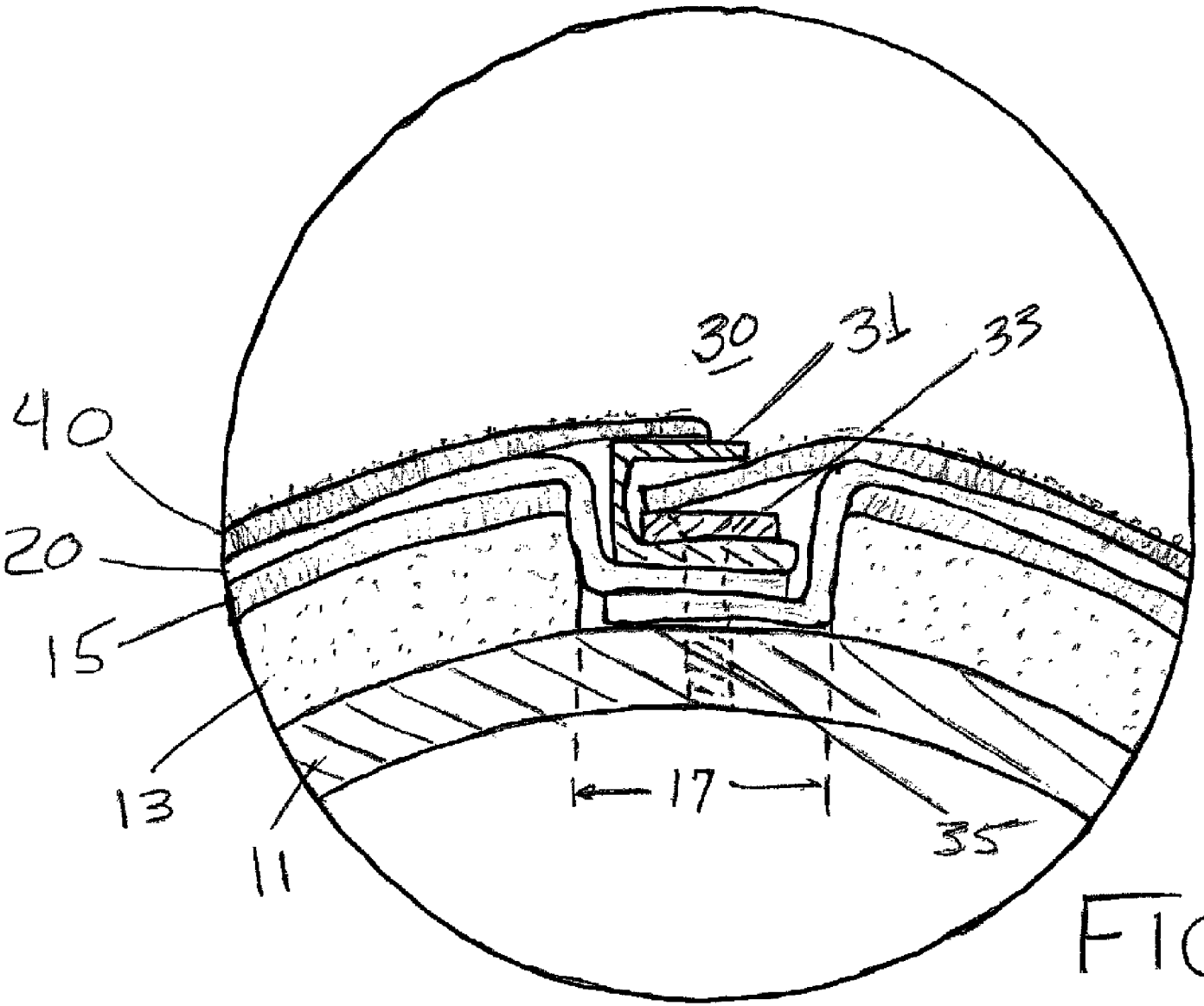
FIG. 8 is a partial, close up view of the paper guide section of FIG. 7.
Figures 9A, 9B, 9C:
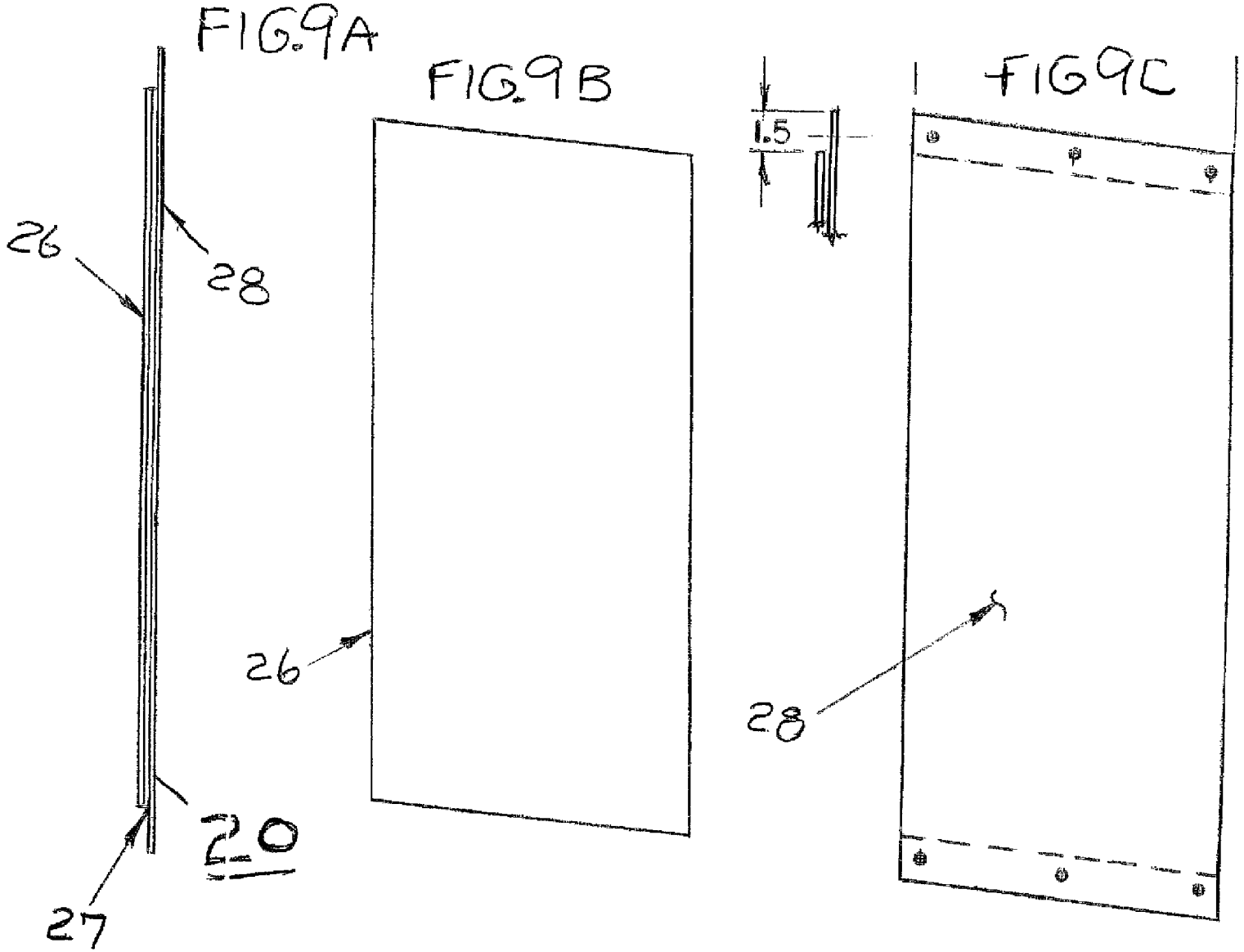
FIGS. 9A, 9B and 9C are views of one embodiment of the removable drum surface of FIG. 7.
Figure 10:
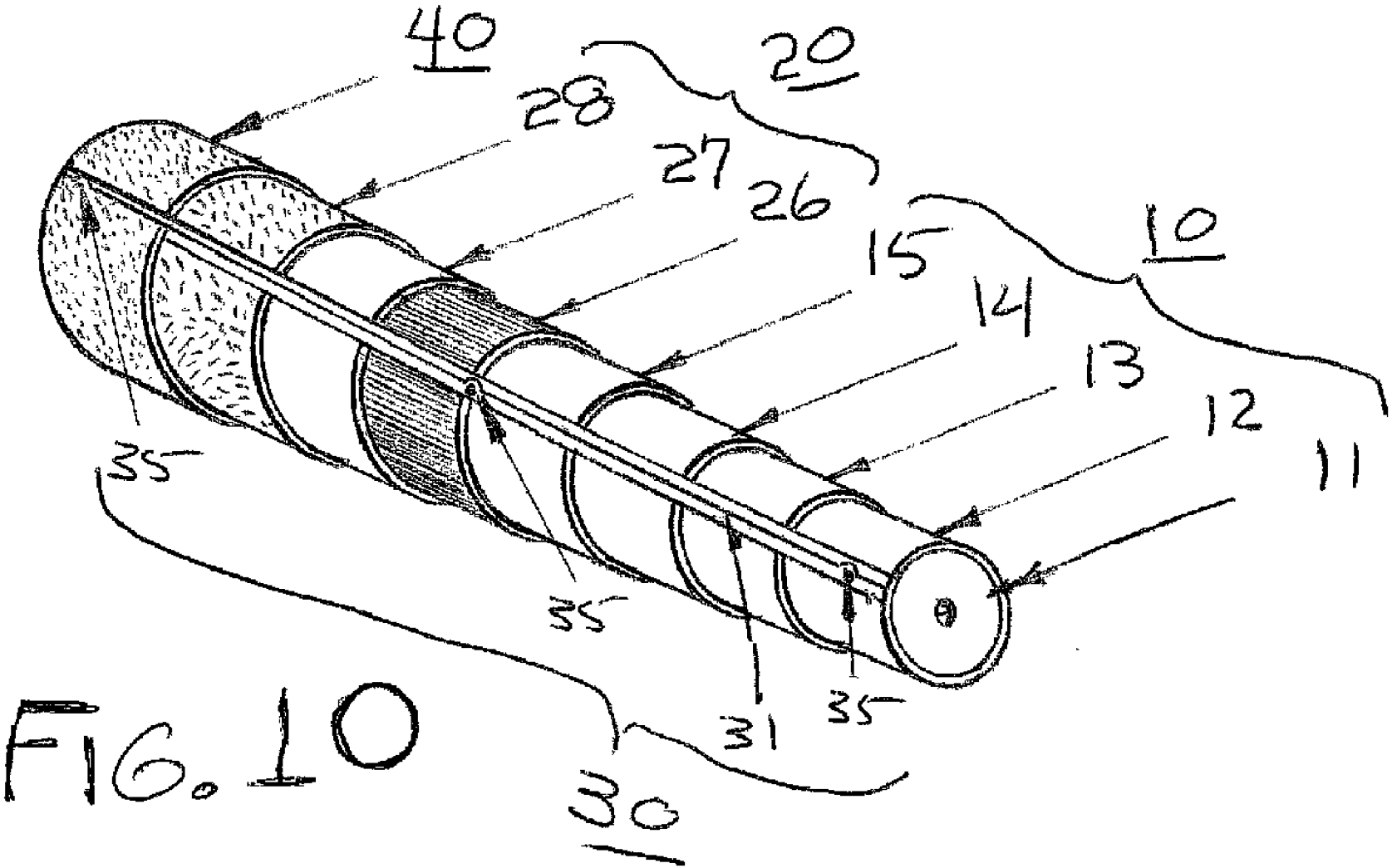
FIG. 10 is a layer by layer cut-away perspective view of one embodiment of the invention.

Referring to FIG. 8 in particular, in the previously described retention slot 17 between the ends of compliant layer 13, a short length of each end of topside layer 28 is folded down and forward so as to overlap on the surface of drum core 11. Paper guide 30 consists of a U or channel shaped steel paper alignment guide bar 31, configured to lay on its side so as to open in a clockwise direction with reference to this view, opposite the direction of rotation of the drum when operating. Paper alignment guide bar 31 and the overlapping ends of topside layer 28 of drum surface layer 20 are both secured to drum core 11 by a full length retention bar 33 positioned within the channel of guide bar 31 against the lower side of the guide bar, through which three spaced apart screws 35 extend into drum core 11. The opposing side of guide bar 31 is notched for easy access to the heads of screws 35.

The pocket formed by guide bar 31 gives paper guide 30 its primary functionality, which is to support the easy, substantially tangential or non-folding abutment of the leading edge of a sanding blank 40 to a fixed guide member for proper alignment for wrapping it around drum surface layer 20 as shown. Sanding blanks 40 are precut for proper fit for respective drum sizes. Upon placement against the guide member, a sanding blank is simply wrapped with hand pressure onto the drum as the drum is manually rotated forward, meshing the hook and loop materials in the manner well understood by those skilled in the art. Once applied, a sanding blank is easily removed by simply peeling apart the mated hook and loop materials, starting with the trailing edge. This facilitates changing of sanding blanks by inexperienced users, without the need for tools or mechanical adjustments.

As is apparent from the figures, guide bar 31 and retention bar 32 in this embodiment provide the further functionality of securing the ends of drum surface layer 20 within the space between the ends of compliant layer 13. All components are sized to provide that the height or radius of installed paper guide 30 with respect to the axis of drum 10 is at or slightly below the height or radius of drum surface layer 20, in order to insure that there is no protruding hump or bump to the otherwise uniformly round mounting surface of the sanding drum.

Should drum surface layer 20 become damaged, as by use on a particularly rough floor surface with loose boards or protruding nails, it can easily be repaired by removing of paper guide 30, and peeling apart the mated hook and loop materials, starting with either edge of drum surface layer 20, and installing a new drum surface layer 20 in reverse order, beginning with careful alignment of a first edge in retention slot 17, and confirming the wrapping and mating alignment of the other edge before reinstalling paper guide 30.

The invention is susceptible of other and various embodiments. For example, there is a powered floor sanding system that is adapted to use a sanding blank that is a sheet of sand paper laminated back to back with a first component layer of a sanding blank hook and loop fastener. This may be a commercially available, off the shelf item, or made to a user's particular specification. The first component layer of the sanding blank hook and loop material can be either the loop or hook component.

An example of a sanding drum is a drum core for a drum type floor sander, configured with a compliant sole to which is adhered a first component layer, which may be hook or loop, of a drum hook and loop fastener system so as to substantially cover the compliant sole. It may have a removable drum surface in the form of a mating component layer to the first component layer of the drum hook and loop fastener system adhered back to back to a mating component layer of a sanding blank hook and loop fastener system. The specifications of the drum hook and loop materials may be the same or different than the specifications for the sanding blank hook and loop materials. The removable drum surface may be applied to the drum by a substantially full surface area contact of the two components of the hook and loop fastener system. It may be further secured to the drum via edge gripping devices or other mechanical fasteners, or by adhesive or a combination of these.

There may be incorporated with the drum a sanding blank alignment guide or "paper" guide, to which one end of a sanding blank can be abutted for alignment for wrapping the sanding blank around the removable drum surface. There may be more than one paper guide, preferably uniformly distributed around the drum, such that two or more sanding blanks of lengths shorter than the circumference of the drum can be used. Each sanding blank should extend from the paper guide around the drum to the same or the next paper guide, leaving no exposed drum surface. There is also a motorized drum-type floor sanding machine chassis configured to accept and rotate such a sanding drum fitted with such a sanding blank.

As another example, the compliant sole of this drum may have a retention slot configured therein, as by leaving a space between the ends of a wrapped layer or layers of compliant material, or by creating a groove or recess in the compliant covering of a drum, so that a sanding blank alignment guide can be recessed in the retention slot at or below the height of the removable drum surface. At least one end or both ends of the removable drum surface, or of at least one layer of the removable drum surface, such as the top or outer layer, may extend into and be secured within said retention slot, whether separately secured or by being abutted or overlapped and secured by a common retention means.

The retention means for further securing the removable drum surface may be the sanding blank alignment guide, or it may be a separate structure, set of fasteners, or fastening assembly. The sanding blank alignment or paper guide may be a bar or extrusion or other elongate, formed structure, or it may be a pair or more of separate guides, suitably positioned for receiving the leading edge of the sanding blank. It may further be notched to match notches in the leading edge of the sanding blank, or have end caps, or be otherwise laterally indexed to locate the sanding blank laterally against the guide.

The paper guide may have a rectangular or L or U-shaped profile. The surface of the paper guide intended for use for edge alignment of a sanding blank, or the open top of the paper guide if it is U-shaped, may face or be open in a direction generally tangent to the circumference of the drum and opposite the direction of rotation of the drum, so as to receive the leading edge of the sanding blank in a substantially planar manner. In the alternative, it may be upward facing or normal to the surface of the drum, requiring a right angle bend to the sanding blank for wrapping around the drum, or it may be at some angle in between.

Other and various embodiments within or equivalent to what is described, illustrated and claimed herein will be readily apparent to those skilled in the art.

I claim:

1. A sanding drum system for a motorized drum-type floor sanding machine, comprising:

a sanding blank comprising a sheet of sand paper laminated back to back with a first component layer of a sanding blank hook and loop fastener;

a drum core with a compliant sole to which is adhered a first component layer of a drum hook and loop fastener system so as to substantially cover said compliant sole;

a removable drum surface comprising a mating component layer to said first component layer of said drum hook and loop fastener system adhered back to back to a mating component layer of said sanding blank hook and loop fastener system; and a sanding blank alignment guide to which one end of said sanding blank may be abutted for alignment for wrapping said sanding blank around said removable drum surface, said sanding blank alignment guide having a U-shaped profile open in a direction generally tangent to the circumference of said drum and opposite the direction of rotation of said drum.

2. The sanding drum system of claim 1, said compliant sole having a retention slot configured therein, said sanding blank alignment guide being recessed therein at or below the height of said removable drum surface.

3. The sanding drum system of claim 2, at least one end of said removable drum surface extending into and secured within said retention slot.

4. The sanding drum system of claim 3, both ends of said removable drum surface extending into and secured within said retention slot.

5. The sanding drum system of claim 3, said at least one end of said removable drum surface secured within said retention slot by said sanding blank alignment guide.

6. The sanding drum system of claim 1, the two said mating component layers of said removable drum surface each comprising hook component layers of their respective drum hook and loop fastener system and sanding blank hook and loop fastener system; the first component layers of both respective said hook and loop fastener systems being loop component layers.

7. A motorized drum-type floor sanding machine adapted to accept a sanding blank comprising a sheet of sand paper laminated back to back with a first component layer of a sanding blank hook and loop fastener, comprising:

a sanding drum comprising:

a drum core with a compliant sole to which is adhered a first component layer of a drum hook and loop fastener system so as to substantially cover said compliant sole;

a removable drum surface comprising a mating component layer to said first component layer of said drum hook and loop fastener system adhered back to back to a mating component layer of a sanding blank hook and loop fastener system; and a sanding blank alignment guide to which one end of a said sanding blank may be abutted for alignment for wrapping said sanding blank around said removable drum surface, said sanding blank alignment guide having a U-shaped profile open in a direction generally tangent to the circumference of said drum and opposite the direction of rotation of said drum; and a motorized drum-type floor sanding machine chassis configured to accept and rotate said sanding drum.

8. The motorized drum-type floor sanding machine of claim 7, said compliant sole having a retention slot configured therein, said sanding blank alignment guide being recessed therein at or below the height of said removable drum surface.

9. The motorized drum-type floor sanding machine of claim 8, at least one end of said removable drum surface extending into and secured within said retention slot.

10. The motorized drum-type floor sanding machine of claim 9, both ends of said removable drum surface extending into and secured within said retention slot.

11. The motorized drum-type floor sanding machine of claim 9, said at least one end of said removable drum surface secured within said retention slot by said sanding blank alignment guide.

12. The motorized drum-type floor sanding machine of claim 7, the two said mating component layers of said removable drum surface each comprising hook component layers of their respective drum hook and loop fastener system and sanding blank hook and loop fastener system; the first component layers of both respective said hook and loop fastener systems being loop component layers.

13. A powered floor sanding system comprising:

a sanding blank comprising a sheet of sand paper laminated back to back with a first component layer of a sanding blank hook and loop fastener;

a sanding drum comprising:

a drum core with a compliant sole to which is adhered a first component layer of a drum hook and loop fastener system so as to substantially cover said compliant sole;

a removable drum surface comprising a mating component layer to said first component layer of said drum hook and loop fastener system adhered back to back to a mating component layer of a sanding blank hook and loop fastener system; and a sanding blank alignment guide to which one end of a said sanding blank may be abutted for alignment for wrapping said sanding blank around said removable drum surface, said sanding blank alignment guide having a U-shaped profile open in a direction generally tangent to the circumference of said drum and opposite the direction of rotation of said drum; and a motorized drum-type floor sanding machine chassis configured to accept and rotate said sanding drum.

14. The powered floor sanding system of claim 13, said compliant sole having a retention slot configured therein, said sanding blank alignment guide being recessed therein at or below the height of said removable drum surface.

15. The powered floor sanding system of claim 14, at least one end of said removable drum surface extending into and secured within said retention slot.

16. The powered floor sanding system of claim 15, both ends of said removable drum surface extending into and secured within said retention slot.

17. The powered floor sanding system of claim 15, said at least one end of said removable drum surface secured within said retention slot by said sanding blank alignment guide.

18. The powered floor sanding system of claim 13, the two said mating component layers of said removable drum surface each comprising hook component layers of their respective drum hook and loop fastener system and sanding blank hook and loop fastener system; the first component layers of both respective said hook and loop fastener systems being loop component layers.

* * * * *